United States Patent [19]

Culbertson

[11] 4,140,477

[45] Feb. 20, 1979

[54] STEAM ATOMIZING BURNER

[75] Inventor: James F. Culbertson, San Carlos, Calif.

[73] Assignee: Envirotech Corporation, Menlo Park, Calif.

[21] Appl. No.: 826,010

[22] Filed: Aug. 19, 1977

Related U.S. Application Data

[63] Continuation-in-part of Ser. No. 736,621, Oct. 28, 1976.

[51] Int. Cl.[2] ..... F23D 15/00

[52] U.S. Cl. ..... 431/175; 431/350; 431/351; 239/424; 239/428

[58] Field of Search ..... 431/159, 181, 187, 265, 431/278, 284, 285, 333, 350, 351, 353, 354, 175; 239/419.5, 424, 427.5, 428

[56] References Cited

U.S. PATENT DOCUMENTS

| | | | |
|---|---|---|---|
| 2,531,538 | 11/1950 | Smith | 431/265 |
| 3,115,851 | 12/1963 | Ceely | 431/175 |
| 3,223,136 | 12/1965 | Mutchler | 431/265 |
| 3,529,917 | 9/1970 | Lang | 431/351 |
| 3,775,038 | 11/1973 | Pillard | 431/278 |

*Primary Examiner*—Carroll B. Dority, Jr.

*Attorney, Agent, or Firm*—William S. Bernheim; Robert E. Krebs

[57] ABSTRACT

A burner in which steam is utilized to atomize fluid fuels such as natural gas and fuel oils. The burner includes a first tubular housing having a first outlet defined at one end; and a second tubular housing fixedly mounted within the first housing having an end which defines an exit adjacent and enclosed by the first outlet and so mounted to define an annular space between the housings. The burner further includes a plurality of fuel nozzles mounted within the second housing wherein an initial mixture of steam and a fluid fuel is formed and from which the initial mixture is emitted toward the exit and a confluence with air flowing in said annular passage so that a combustible mixture is formed; and a turbulator ring mounted within and at the exit to define a sharp-edged orifice and a narrow annular orifice.

2 Claims, 6 Drawing Figures

STEAM ATOMIZING BURNER

CROSS REFERENCE TO A RELATED APPLICATION

This application is a continuation-in-part of my copending application Ser. No. 736,621 filed Oct. 28, 1976.

BACKGROUND OF THE INVENTION

1. Field of Invention

This invention generally relates to a burner in which steam is utilized to atomize fluid fuels.

2. Prior Art

Oil burners are often mounted to fire through a tile chamber. The tile chamber serves as a secondary ignition device to prevent the relatively cold incoming fuel mixture from blowing the flame from the burner which produces an ignition failure, a condition known as blow off.

Tile chambers are undesirable as they increase the space requirement of a burner. In addition, heat is lost by radiation, the tiles deteriorate and the turndown ratio (maximum divided by minimum heat output) is limited. Turndown ratios of 2-1 to 3-1 are typical. The tiles also prevent burning of fuels which contain components which chemically attack the tiles.

Typically to change burner fuels from gas to oil or the reverse, requires replacing the fuel nozzle which can necessitate shutdown of the apparatus in which the burner is utilized.

In U.S. Pat. No. 2,863,499 a burner is taught which burns a variety of liquid fuels. The burner is operative only at high heat output and has a turndown ratio of maximum to minimum heat output of less than 2 to 1.

In U.S. Pat. No. 3,326,472 the burner of U.S. Pat. No. 2,863,499 is modified to allow use of gas as an alternative fuel. The modified burner introduces a gas-air mixture to the air tube of the unmodified burner of U.S. Pat. No. 2,863,499 by attaching to the air tube a gas line having specially designed apertures therein for admitting air. When burning gas the modified burner is susceptible to backfire through the apertures and blow off. The range of heat output with gas, when the burner is not susceptible to backfire or blow off, does not overlap the range of heat output with oil.

Control of burner flame configuration particularly in multiple hearth furnaces, is desireable to prevent melting of metal surfaces or hot spots.

OBJECTS OF THE INVENTION

It is an object of this invention to provide a burner including multiple fuel nozzles and means for introducing to the fuel downstream of the nozzles the major portion of the air needed for combustion.

Another object is to provide a burner which achieves mixing and stable combustion without moving parts and does not utilize a tile chamber for secondary ignition.

Yet another object is to provide a furnace burner which can alternatively burn gas, oil or a combination thereof with a turndown ratio of at least 3 to 1.

BRIEF DESCRIPTION OF THE DRAWINGS

Further objects and advantages of the invention will be apparent from the following detailed description, taken in conjunction with the accompanying drawings illustrating preferred embodiments of the invention.

In the drawings.

DETAILED DESCRIPTION OF THE PREFERRED EMBODIMENT

Figure 1:
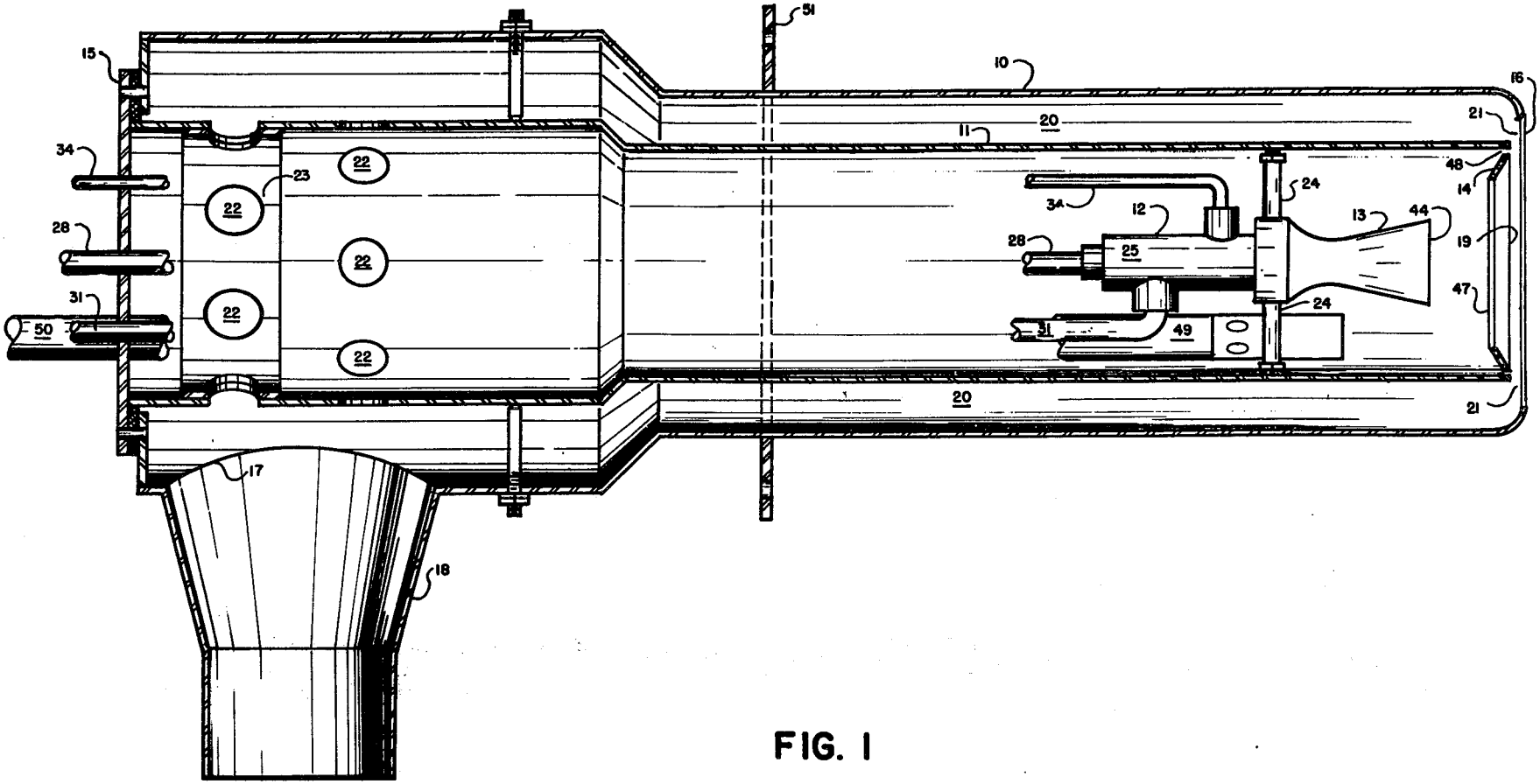
FIG. 1 is a side view partially in section, showing a burner according to the present invention.

The main components of the burner illustrated in FIG. 1 include a first tubular housing 10, a second tubular housing 11, a fuel nozzle 12, a venturi member 13 and a turbulator ring 14, the latter three being mounted within the second housing 11. The first housing is closed by a plate 15. At the opposite end of the housing there is formed an inwardly directed lip which defines a circular outlet 16. Spaced from the outlet 16 and preferably adjacent the first end, an aperture 17 is formed through the side wall of the first housing 10 and a duct 18 is connected thereabout to convey air into the housing. The second housing 11 is fixedly mounted within, spaced from and extends the length of the first housing 10. The second housing 11 is an open-ended tubular member and the two housings are substantially coaxial at the outlet 16 end of the housings. The second housing 11 is closed at one end by the plate 15 and at the opposite end defines a circular exit 19 adjacent and enclosed by the outlet 16 of the first housing 10.

Defined between the interior wall of the first housing 10 and the exterior wall of the second housing 11 is an annular space 20 which extends from the aperture 17 to the outlet 16. At the outlet 16, the ends of the first and second housings define therebetween an annular orifice 21 downstream of the fuel nozzle 12 and which produces a funneling output. Adjacent the aperture 17 and spaced from the exit 19, a plurality of holes 22 are formed through the second housing. The holes 22 are spaced circumferentially about the second housing to allow air passage between the annular space 20 and the interior of the second housing. The holes 22 are sized and a slidable damper 23 provided such that under operating conditions, air admitted through aperture 17 to the annular space 20 is split with a major portion exiting from the orifice 21 and a minor portion exiting through the holes 22 into the second housing 11.

Figure 2:
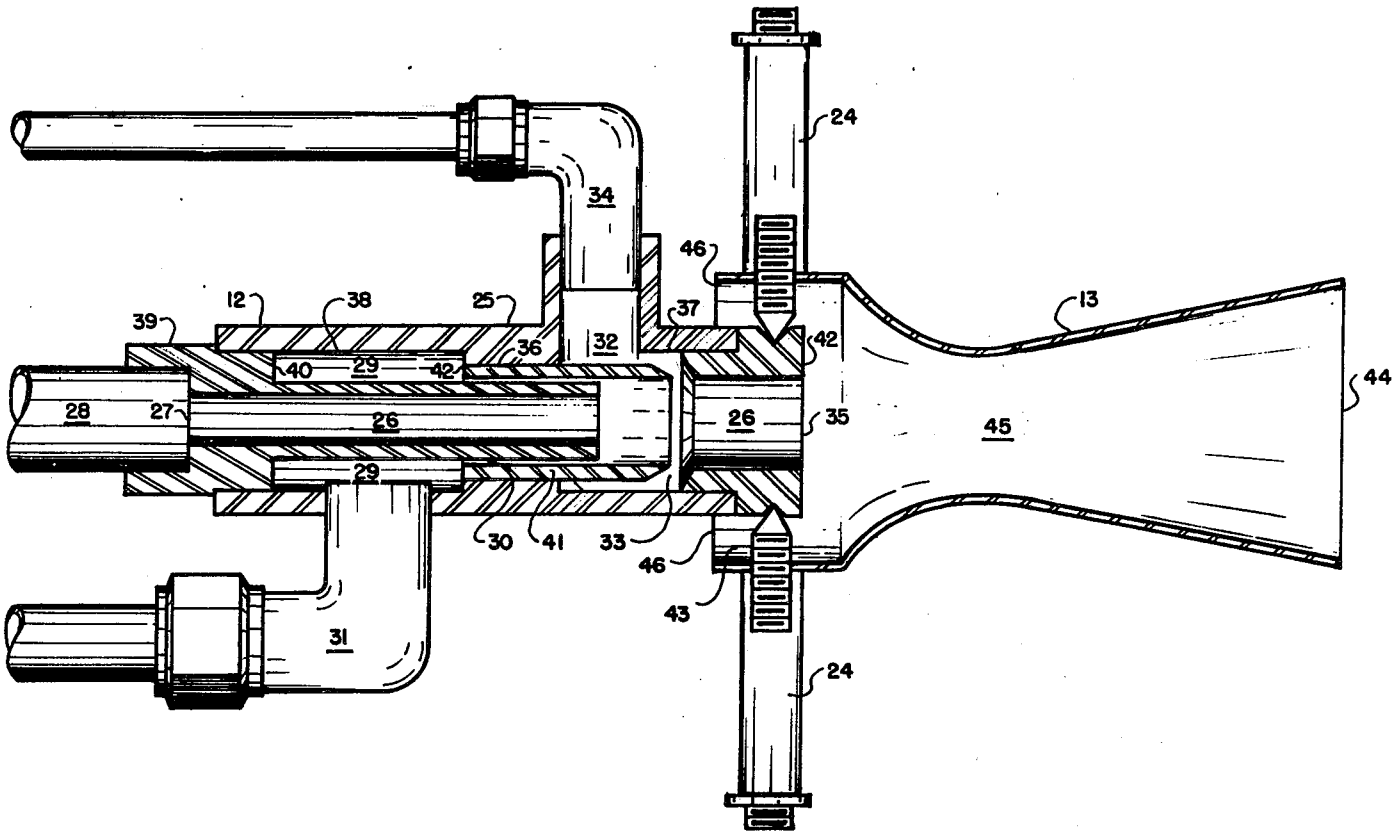
FIG. 2 is an enlarged side view of the fuel nozzle 12 and venturi member 13 shown in FIG. 1.
Figure 3:
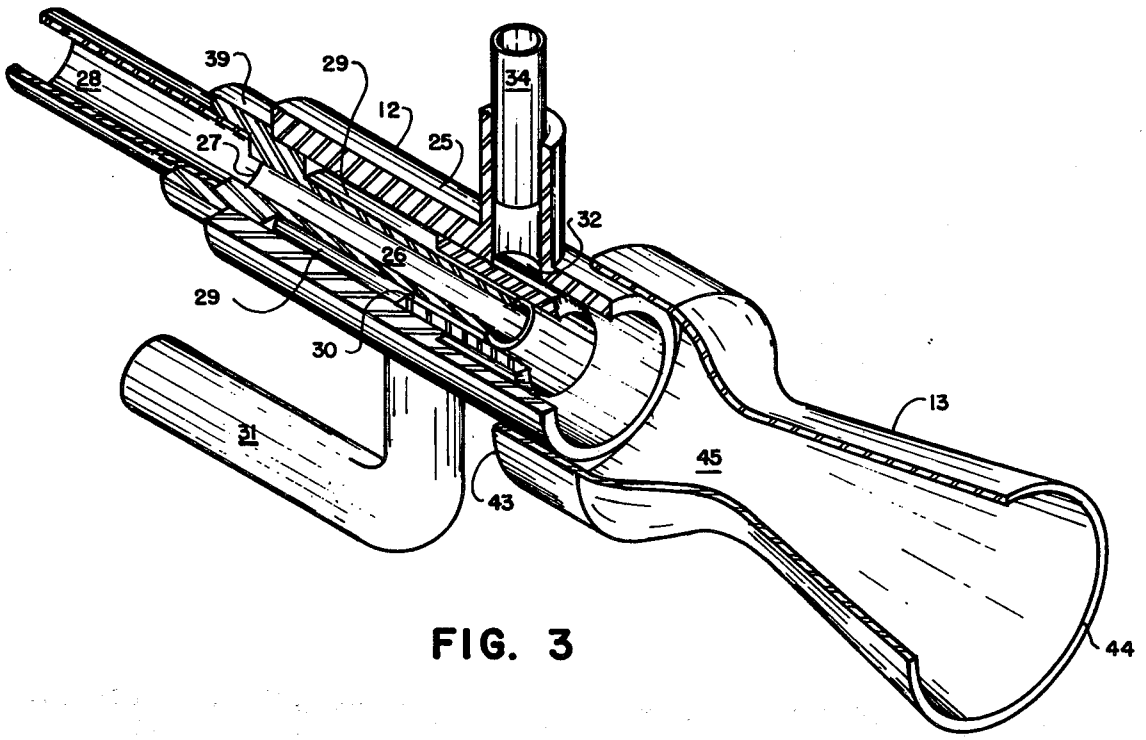
FIG. 3 is a perspective view of the fuel nozzle 12 and venturi member 13 shown in FIG. 1 but with the discharge tube 42 removed.

Referring also to FIGS. 2 and 3, the fuel nozzle 12 is mounted within the second housing 11 by means of struts 24 or similar means which allow translation of the fuel nozzle 12 along the length of the second housing. The fuel nozzle 12 forms an initial mixture of steam and fuel (either gas or oil) and includes a generally cylindrical elongated body 25 having defined therein an open-ended cylindrical mixing chamber 26. A portion of the mixing chamber 26 is surrounded by an annular steam chamber 29 having a restricted annular outlet 30 in communication with the mixing chamber 26 which increases in diameter thereat. Connected in communication with the steam chamber is a conduit 31.

A portion of the mixing chamber 26 is also surrounded by an annular oil chamber 32 having a restricted annular outlet 33 in communication with the mixing chamber 26 which increases in diameter thereat. Connected in communication with the oil chamber 32 is a conduit 34. The steam outlet 30 communicates to the mixing chamber between the gas inlet 27 and the oil outlet 33. At the other end of the mixing chamber 26, an open circular outlet 35 is defined to emit the initial mixtures of steam with either gas or oil or both in the direction of the outlet 16.

In greater particularity, the mixing chamber 26 is formed with a longitudinal bore 36 connecting and coaxial to a front counterbore 37 and a rear counterbore 38. An inner barrel 39 is fixedly mounted in the cylindrical body 25 to extend coaxially to telescope with the longitudinal bore 36. The exterior wall of the inner barrel 39 and the rear counterbore 38 forms walls for the annular steam chamber 29. A backwall 40 of the steam chamber 29 is provided by an increase in the exterior diameter of the inner barrel 39. An outer barrel 41 is mounted in the cylindrical body 25 to extend coaxially with the longitudinal bore 36 and telescope over the inner barrel 39. The interior wall of said outer barrel 41 and exterior wall of the inner barrel 39 define the annular outlet 30. The outer barrel 41 and a portion of the cylindrical body 25 provide the front wall 42 of the steam chamber 29. The inner barrel 39 and the outer barrel 41 are each hollow, circular and symmetrical. The exterior wall of the outer barrel 41 and the front counterbore 37 form walls for the annular oil chamber 32. A hollow circular symmetrical discharge tube 42 is mounted into the front couterbore 37 coaxial with the outer barrel 41 to define the outlet 35 and along with the front counterbore 37 and the exterior wall of the outer barrel 41 to define an oil outlet 33. The conduits supplying the gas, steam and oil inlets of the nozzle 12 pass out of the burner through the plate 15.

The venturi member 13 has a circular entrance 43, discharge 44 and throat 45, therebetween and is fixedly mounted within the second housing 11 by means of the struts 24 to be coaxial with the mixing chamber 26. The entrance 43 is fixedly positioned at a distance from and encloses the outlet 35 to form an annular air inlet 46 surrounding the outlet 35 such that the initial mixtures of steam and fuel emitted from the outlet 35 are received into the venturi member 13 and air is aspirated into the venturi member through the inlet 46 by the emission of the initial mixtures from the outlet 35. The discharge 44 is spaced from the exit 19 and emits the initial mixtures and air from the venturi member 13 in the direction of the outlet 16.

The turbulator ring 14 as shown in FIG. 1, has the shape of a truncated cone and is fixedly mounted within the second housing 11 and at the exit 19. When a single fuel nozzle 12 is mounted in the second housing 11, the mixing chamber thereof and the turbulator ring 14 are preferably coaxial. The fuel nozzle 12 and venturi member 13 are positioned with the second housing 11 such that a small portion, about 5 to 10% of the initial mixtures and air emitted from the venturi 13 impinges against the turbulator ring 14.

The turbulator ring 14 has its minor diameter nearer the fuel nozzle 12 and therewith forms a circular sharp edged orifice 47 with respect to the mixture emitted from the venturi 13. The major diameter of the turbulator ring is slightly smaller than the inside diameter of the second housing 11 to define between the ring 14 and the interior wall of the second housing 11 a narrow annular orifice 48 at the exit 19. The narrow annular orifice 48 is typically between about 3.2mm ± 1.6mm in width.

Referring again to FIG. 1, a conventional gas pilot burner 49 or like ignition means is mounted in the second housing 11 at the emission end of the fuel nozzle 12 to ignite the combustion mixture. Piping 50 for the pilot burner 49 passes through the back plate 15. A mounting means 51 attached to the first housing 10 allows the combustion apparatus to be mounted to a furnace wall or the like. The back plate 15 is removable and allows removal of the fuel nozzle 12 and venturi 13 of the burner easily and without necessitating shutdown of an apparatus in which the burner is employed.

In operation of the burner with gas as its fuel, gas, preferably natural gas, under a pressure of between about 1.3 and 2 atmospheres, enters the fuel nozzle 12 through the gas inlet 27 to the mixing chamber 26 and flows toward outlet 35. Superheated steam enters the fuel nozzle 12 through steam conduit 31 and fills the steam chamber 29 and emits steam toward outlet 35 through outlet 30. The portion of the mixing chamber 29 surrounded by the steam chamber is heated by the steam which in turn preheats the gas. As emitted from outlet 30 the steam forms a flowing annular sleeve of steam evenly distributed about the circumference of the mixing chamber 26 and surrounding the flowing gas. The sleeve configuration slowly dissolves as the gas and steam mixture is emitted at outlet 35 and enters the venturi member 13.

The gas and steam mixture aspirates air into the venturi member 13 from the second housing 11 through inlet 46. Simultaneously pressurized air is supplied to the annular space 20 through the aperture 17 of which a minor portion enters the second housing 11 through the holes 22 and in turn is the air aspirated through inlet 46. The major portion of air entering the annular space 20 is discharged from the orifice 21 in a converging direction toward a confluence with the mixture leaving the exit 19.

In the venturi member 13, the aspirated air initially forms an annular sleeve about the steam which in turn is a sleeve about the gas. The venturi member 13 constricts the air, steam and gas components as they approach the throat 45 producing acceleration of the components. Thereafter, the components expand with violent boundary layer turbulence to an overexpanded condition at the discharge 44. A collapse of the components from this overexpanded condition occurs between the discharge 44 and the exit 19. The acceleration, expansion and collapse achieves superior atomization and mixing of the components.

A portion of the collapsed components circulates about the turbulator ring 14 with the balance of the components passing directly through exit 19. The collapsed components are deficient in combustion air and such deficiency is satisfied by the air discharged from the orifice 21. Once ignited by the pilot burner 49, combustion is self sustaining.

In operation of the burner with oil as the fuel, pressurized steam enters the fuel nozzle 12 through conduit 31 to fill the steam chamber 29 which in turn feeds steam through outlet 30 into the mixing chamber 26 in the form of a flowing sleeve. Oil is fed at a pressure between about 1.3 and 2 atmospheres through conduit 34 into oil chamber 32. Suitable oil (liquid) fuels include No. 2 fuel oil, No. 6 fuel oil, residual oil, bunker "C" oil and "slop" oil. From the oil chamber 32 the oil is discharged toward outlet 35 through outlet 33 as a flowing annular sleeve of oil evenly distributed about the circumference of the mixing chamber 26 and surrounding the annular sleeve of flowing steam. This double sleeve configuration is slowly dissolved as the steam and oil mixture is emitted at outlet 35 and enters the venturi member 13.

In the venturi member 13 the steam and oil mixture aspirates air through inlet 46. A portion of the components emitted from the venturi member 13 impinge on the turbulator ring 14 as in gas burning. Introduction of a small portion of gas through the gas inlet 27 can assist formation of the annular sleeve of steam emitted from outlet 30.

The venturi member 13 is optional for gas or oil operation but its presence is preferred. In the absence of the venturi member 13, the fuel nozzle 12 is positioned further from the outlet 16 then otherwise to provide impingement on the turbulator ring 14. In oil burning in particular, the pilot burner 49 is needed for ignition until normal operating temperautes are reached. Operation without the venturi member 13 produces a longer thinner flame.

The air flowing through the annular space 20 cools the burner housing adjacent the outlet 16. The heated air is discharged through the orifice 21. Such heating of the air increases the burner combustion efficiency and draws heat from the burner housing where it can be detrimental to the burner's longetivity or wasted heating the surroundings. Approximately 20–30% of the combustion requirement of the air is introduced through the holes 22 and drawn through the inlet 46. The balance of combustion air including any excess is provided through the orifice 21. Varying the ratio of air between the holes 22 and the orifice 21 can be used to affect the flame configuration. The air provided to the orifice 21 also provides pressure directed away from the burner to prevent recirculation of exhaust gases into the second housing 11 and ingestion of dust.

The air in the second tubular houisng 11 is in a static condition in the area outside the venturi member 13 between the entrance 43 and the discharge 44. The damper 23 is adjusted to maintain a negative pressure in the second housing 11 and to cause a small amount of the air provided at the orifice 21 to be induced to reverse its flow and flow into the second housing 11 through the narrow annular orifice 48 where it is met by the outer fringes of the fuel-rich mixture exiting the venturi member 13 and contributes to causing a circulation of fuel mixture around the turbulator ring 14 where, when once ignited, a stationary ring of flame is formed and serves to ignite the emitting fuel/air mixture.

The stream is superheated to assure a steam temperature as the steam leaves outlet 30 of about 125–150° C. The steam leaving the outlet 30 also serves as a steam eductor with respect to the incoming gases from the gas inlet 27 and the incoming oils from the outlet 33 and thereby significantly reduces the pressure required to force either the gas or oil into the fuel nozzle 12. Unexpected gas economy in terms of useful Btu output in the order of 30% is experienced. Steam consumption when burning oil, is typically 21.8 lbs. per million Btu regardless of the oil firing rate. Steam consumption, when burning natural gas, is typically 8 lbs. per million Btu.

The burner can also burn a combination of oil and gas. With a knowledge of burning with either oil or gas, operation with a combination of oil and gas is within the ability of the skilled person. In this mode, at the outlet 35, gas is sleeved by steam which in turn is sleeved by oil.

During operation, the burner's design causes the preponderence of the combustion to occur outside the burner adjacent the outlet 16. This is advantageous when the burner is used in combination with a multiple hearth furnace. The orifice 21 can also serve as an auxiliary input means for introducing additional gaseous components to the furnace. With little difficulty sufficient air can also be provided at the orifice 21 during shutdown of the fuel nozzle to prevent the ingestion of dust and as needed, air can be fed through the holes 22 to discharge any dust ingested.

As shown in FIG. 1, oil introduction to the burner nozzle 12 is made at the top through conduit 34 and the gravity distribution about the oil chamber 32 is sufficient to achieve equal distribution of feed from the oil chamber 32 to the outlet 33. If the burner nozzle is pointed directly downward or the oil conduit is not in position to take advantage of gravity distribution, some other type of auxiliary means to spread oil evenly about the oil chamber 32 is necessary. If the burner nozzle 12 is pointed directly downward it is sufficient if the oil chamber 32 is located to the outlet 35 side of the oil outlet 33.

Figure 4:
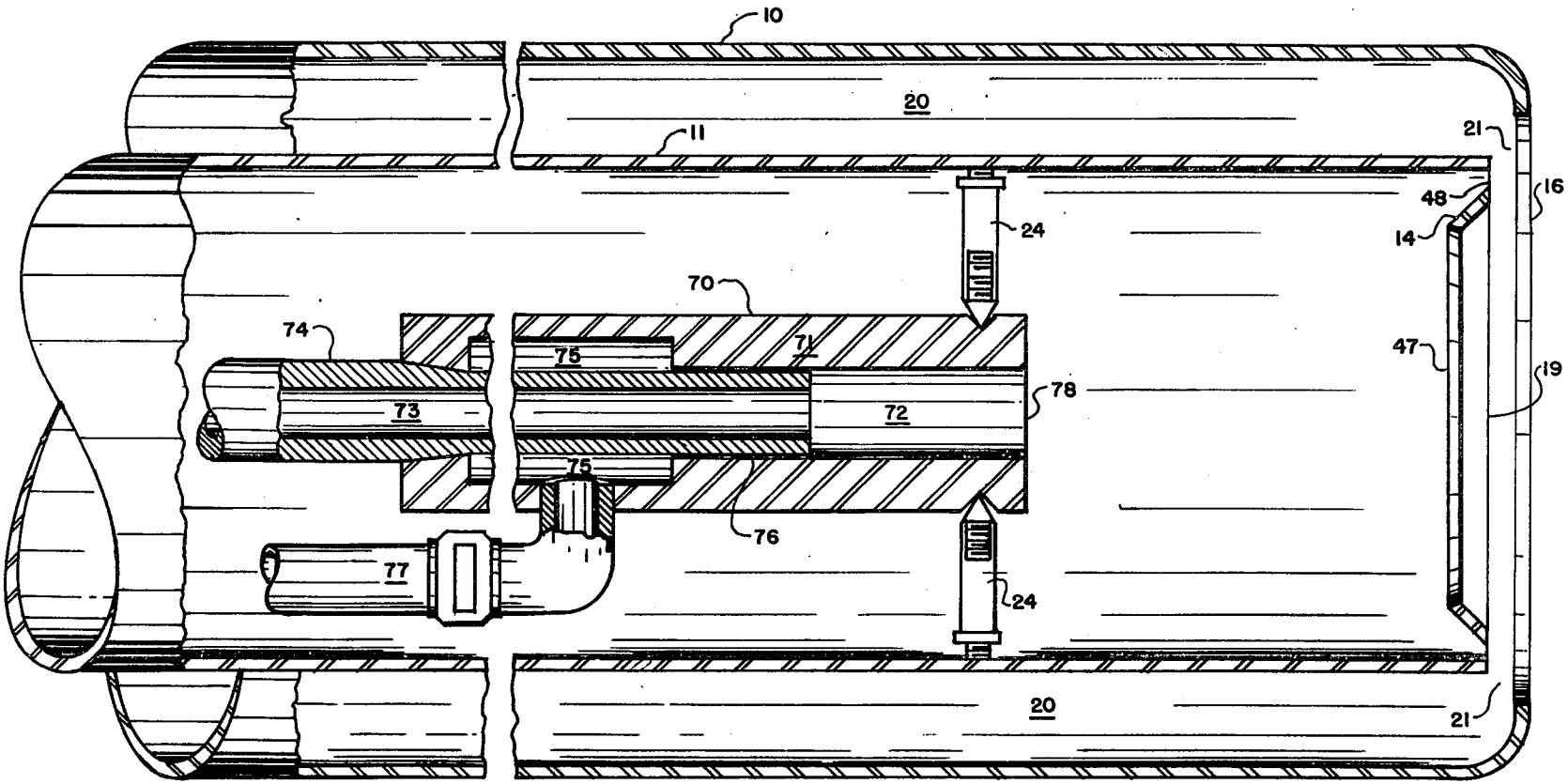
FIG. 4 is a side view showing a fuel nozzle according to the present invention.

The fuel nozzle 12 can be modified as shown in FIG. 4 for burning gas only. The modified gas nozzle 70 is fixedly mounted in place of fuel nozzle 12 within the second housing 11. The fuel nozzle 70 includes a generally cylindrical elongated body 71 having therein an open-ended cylindrical mixing chamber 72. At a first end of the mixing chamber 72 is an inlet 73 for admitting gas into the chamber 72. Providing gas to the gas inlet 73 is a conduit 74. A portion of the chamber 72 is surrounded by an annular chamber 75 for steam having a restricted annular outlet 76 in communication with the mixing chamber which increases in diameter thereat. In communication with the steam chamber 75 is a steam conduit 77. The other end of the mixing chamber 73 defines a circular mixture outlet 78 to emit an initial mixture of steam and gas in the direction of the outlet 16. The venturi member 13 can be optionally mounted to surround the outlet 78.

In operation, the modified gas nozzle 70 operates in the same manner as fuel nozzle 12 for gas burning. Gas enters the mixing chamber 72 through the gas inlet 73. Superheated steam enters to fill the steam chamber 75 through steam conduit 77. From the steam chamber 75 the steam is discharged through the outlet 76 in the form of a flowing annular sleeve of steam evenly distributed about the circumference of the mixing chamber 72 to surround the flowing gas. This initial mixture of gas is then emitted from outlet 78 and is acted upon as discussed supra.

Figure 5:
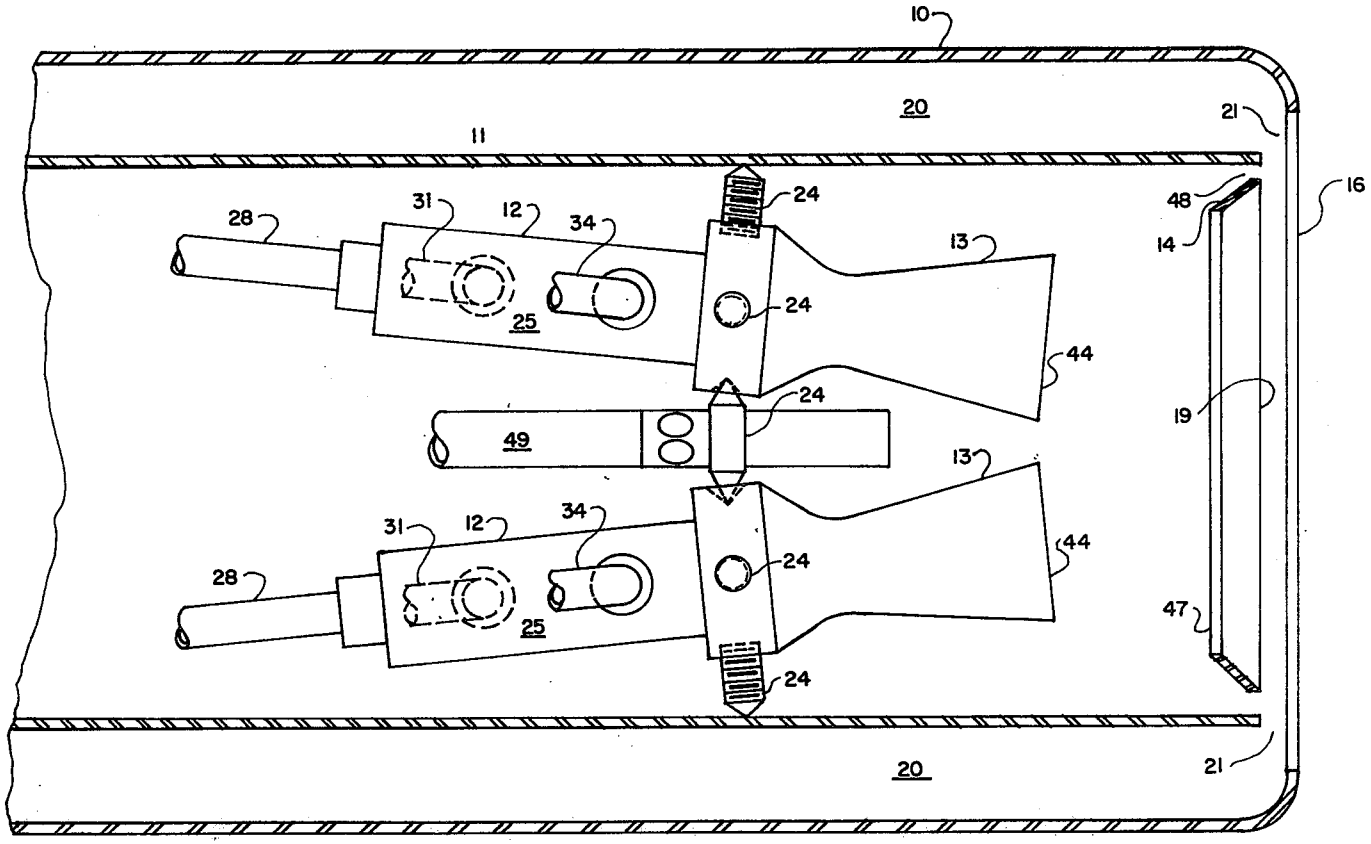
FIG. 5 is a side view partially in section of a burner having a plurality of fuel nozzles according to the present invention.
Figure 6:
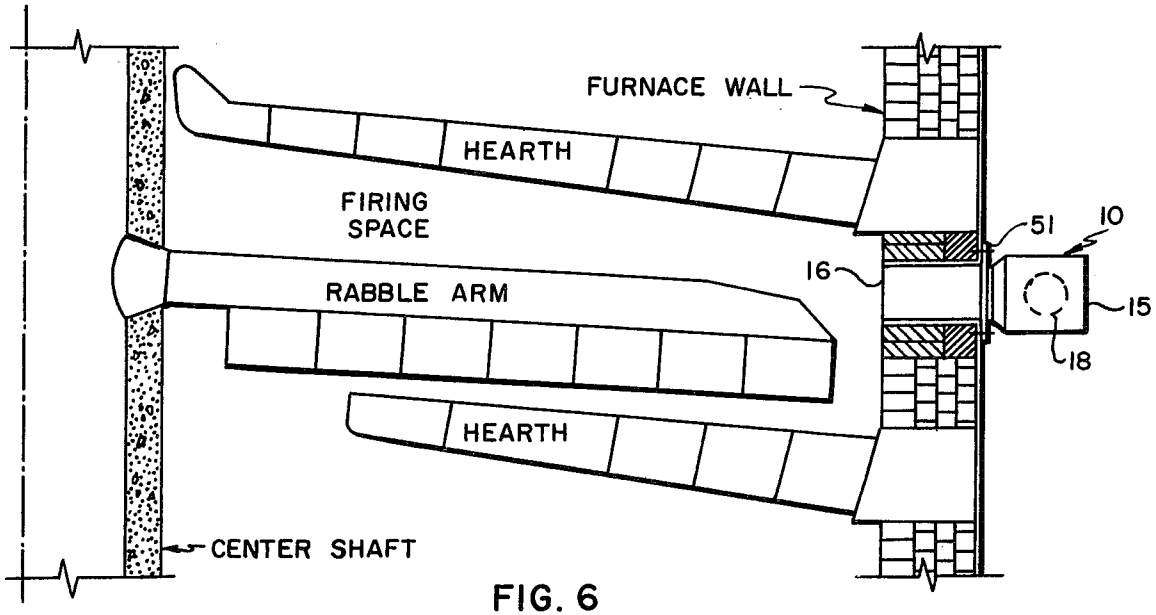
FIG. 6 is a schematic side view of a burner mounted to a multiple hearth furnace according to the present invention.

In FIG. 5, a modification of a combustion apparatus according to the present invention is shown. In this case, two fuel nozzles 12, are mounted within the second tubular housing 11. Together, the two fuel nozzles provide greater heat output capability for the combustion apparatus than a single, larger fuel nozzle 12 within the same sized second tubular housing 12. The individual fuel nozzles 12 of the pair are constructed in the same manner as the singly mounted fuel nozzle 12.

In the illustrated embodiment, the two fuel nozzles 12 are mounted within the second housing 11 by means of struts 24 which extend between the nozzles and between the nozzles and the second housing 11. The struts are adjustable to permit translation of the fuel nozzles 11 along the length of the second housing 11. The two fuel nozzles 12 are mounted side-by-side so that a portion of their jointly emitted components impinge on the turbulator ring 14. To maintain substantially the same coaxial aspects as the single nozzle, the axes of the outlets of the fuel nozzles 12 of the plurality converge at a point on the axis of the circular outlet 16 a short distance outside the first housing 10. Preferably, the distance from the outlet 16 to the convergence point is approximately equal to three times the distance between the axes of the fuel nozzles 12 at their outlets 35. It is also possible to mount within the second housing a large number of fuel nozzles 12 around a ring to obtain high firing rates without increasing flame length, as would be the case with a single large nozzle.

Operation of the burner embodiment in FIG. 5 is the same as that for the singly mounted fuel nozzle 12. The burner is operative with only one of the two fuel nozzles in operation. Therefore, the turn down ratio of two fuel nozzles 12 in place of a single larger fuel nozzle 12 is approximately twice the ratio for the single fuel nozzle 12.

I claim:

1. A combustion apparatus comprising:

a. a first tubular housing having a closed end and an opposite open end whereat an inwardly directed lip is formed to define a first outlet;

b. an aperture means connected to said first housing for admitting air to said first housing spaced from said first outlet;

c. a second tubular housing fixedly mounted within said first housing, said second housing having a closed end and an opposite end which defines an exit adjacent and enclosed by said first outlet so that an annular space is defined between the interior of said first housing and the exterior of said second housing extending from said aperture means to said first outlet whereat an annular orifice is formed and said annular space passes a major portion of air admitted to said first housing by said aperture means to emit at said orifice;

d. means connected to said second tubular housing to admit air from said annular space into said second tubular housing at a location spaced from said exit;

e. a plurality of fuel nozzles mounted within said second tubular housing wherein an initial mixture of steam and a fluid fuel is formed; each of said fuel nozzles of said plurality further having a mixture outlet to emit parts of the initial mixture in a direction toward said exit and a confluence with said major portion of air; the major portion providing air for combusting the initial mixture; and f. a turbulator ring fixedly mounted within and at the exit of said second housing to define a sharp-edged orifice with respect to the initial mixture emitted from said mixture outlets and to define a narrow annular orifice between said turbulator ring and the interior of said second housing.

2. A combustion apparatus according to claim 1 further including a multiple hearth furnace to which said first housing is mounted.

* * * * *